US005480312A

United States Patent [19]

Watanabe et al.

[11] Patent Number: 5,480,312

[45] Date of Patent: Jan. 2, 1996

[54] PROTECTING CAP FOR PANEL-MOUNTED ELECTRICAL CONNECTOR

[75] Inventors: Kaoru Watanabe; Hajime Kawase, both of Mie, Japan

[73] Assignee: Sumitomo Wiring Systems Ltd., Mie, Japan

[21] Appl. No.: 208,278

[22] Filed: Mar. 10, 1994

[30] Foreign Application Priority Data

Mar. 11, 1993 [JP] Japan ..... 5-016910 U

[51] Int. Cl.[6] ..... H01R 13/44

[52] U.S. Cl. ..... 439/135; 439/148

[58] Field of Search ..... 439/718, 135, 439/148, 133

[56] References Cited

U.S. PATENT DOCUMENTS

| | | | |
|---|---|---|---|
| 2,987,690 | 6/1961 | Marbais | 439/135 OR |
| 4,541,538 | 9/1985 | Swetnam | 439/135 X |
| 4,742,541 | 5/1988 | Cwirzen et al. | 439/718 X |
| 5,003,128 | 3/1991 | Grondin | 439/135 X |
| 5,183,971 | 2/1993 | Lafosse et al. | 439/724 X |
| 5,277,601 | 1/1994 | Miyazawa | 439/135 OR |
| 5,285,014 | 2/1994 | Gilchrist | 439/135 X |

FOREIGN PATENT DOCUMENTS

| | | |
|---|---|---|
| 54-116694 | 9/1979 | Japan . |
| 3-55263 | 12/1991 | Japan . |
| 5-87844 | 11/1993 | Japan . |

*Primary Examiner*—David L. Pirlot
*Assistant Examiner*—Daniel Wittels
*Attorney, Agent, or Firm*—Wenderoth, Lind & Ponack

[57] ABSTRACT

A protecting cap is used for protecting a plurality of terminals disposed in a cylindrical portion of an electrical connector to be inserted in a mounting hole formed in a panel so that an open end of the cylindrical portion faces the mounting hole. The protecting cap is attached to the open end of the cylindrical portion. The protecting cap includes a lid portion covering the open end of the cylindrical portion of the connector and a pair of engagement members attaching the lid portion to the cylindrical portion of the connector. The lid portion has inclined faces so that the lid portion tapers in a direction away from the open end of the cylindrical portion. Since the protecting cap is tapered, it can be readily inserted into the mounting hole. Upon insertion of the distal end of the cap into the mounting hole, the connector can be guided to a normal position even when it is positionally offset relative to the mounting hole.

8 Claims, 6 Drawing Sheets

PROTECTING CAP FOR PANEL-MOUNTED ELECTRICAL CONNECTOR

BACKGROUND OF THE INVENTION

1. Field of the Invention

This invention relates to a protecting cap for a panel-mounted electrical connector including a cylindrical portion holding therein terminals and mounted in a mounting hole formed in a panel with an open end of the cylindrical portion facing the mounting hole, the protecting cap covering the open end of the cylindrical portion to protect the terminals therein.

2. Description of the Prior Art

The electrical connector mentioned above includes those attached to panels composing a door or a body of an automobile so that electric parts equipped in the door are connected to the body side. FIG. 8 illustrates a conventional panel-mounted electrical connector 1. The connector 1 includes a front bottomed cylindrical hood 2. A plurality of male terminals 3 are held on a inner wall of the hood 2 so as to project toward its front open end. A flange 4 is formed on the outer periphery near the front end of the hood 2. When the connector 1 is inserted into a mounting hole W of a panel P, the flange 4 collides against panel P. A pair of slit-like notched portions are formed in each of upper and lower walls to extend from the open end toward the inner wall. Two locking arms 5 each formed into the shape of a plate with a small width and having elasticity are provided between the respective pairs of notched portions Each locking arm has a protrusion 6 formed on the outer peripheral side of its distal end. Each protrusion 6 has an inclined front side and a rear vertical end. A distance between the rear vertical wall surface and the front end wall surface of the flange 4 is so set as to be approximately equal to the thickness of the panel P.

Since the male connectors 3 project in the hood 2, something can invade the hood 2 to strike against the male connectors 3 during transportation such that some or all the male connectors 3 bend. To prevent this, a protecting cap 7 is attached to the open end of the hood 2 to preliminarily close the end. The protecting cap 7 is inserted into the open end of the hood 2 so that the connector 1 with the cap 7 being attached thereto can be mounted on the panel P.

When the connector is inserted into the mounting hole W of the panel P with the protecting cap 7 being attached thereto, the cap 7 abuts against the panel P and accordingly, the connector cannot be inserted further if both the connector and the cap 7 are not accurately positioned, as shown in FIG. 9. In this case, the mounting work is troublesome. In particular, the connector needs to be mounted by touch when the mounting hole W cannot be viewed by the worker, which poses a problem of low working efficiency.

SUMMARY OF THE INVENTION

Therefore, an object of the present invention is to provide a protecting cap for a panel-mounted electrical connector wherein the connector mounting work can be simplified.

Another object of the invention is to provide a protecting cap for a panel-mounted electrical connector wherein the cap can be prevented from falling off of the connector. Further, another object of the invention is to provide a protecting cap for a panel-mounted electrical connector wherein resistance caused in the insertion of the cap into the connector can be reduced.

Further, another object of the invention is to provide a protecting cap for a panel-mounted electrical connector wherein the cap can be readily pushed in after the distal end thereof has been inserted.

Further, another object of the invention is to provide a protecting cap for a panel-mounted electrical connector which can be manufactured readily.

The present invention provides a protecting cap in combination with an electrical connector having a cylindrical portion housing a plurality of terminals and insertable into a mounting hole formed in a panel so that an open end of the cylindrical portion faces the mounting hole. The protecting cap is attached to the open end of the cylindrical portion. The protecting cap comprises a lid portion covering the open end of the cylindrical portion of the connector, the lid portion having inclined faces so as to be tapered in a direction away from the open end of the cylindrical portion, and a pair of engagement members attaching the lid portion to the cylindrical portion of the connector. The inclined faces may be the side faces of the lid portion, or projecting portions may be provided on the distal end of the lid portion and the inclined faces may be formed on the projecting portions.

Since the protecting cap is tapered, it can be inserted into the mounting hole readily. Upon insertion of the distal end of the protecting cap, the connector can be pushed in and guided to its normal position even if the connector is offset relative to the mounting hole.

The lid portion preferably has a generally trapezoidal cross section and each inclined face has a convex portion so that the same does not project beyond an imaginary line extending perpendicular to the base of the trapezoid from a corner of the trapezoid at its base. The protecting cap is attached to the connector by means of the engagement members so as to cover the open end of the cylindrical portion of the connector. In detachment of the cap from the connector, the detaching work is performed at the opposite side of the panel through which the connector is mounted. The protecting cap is held at its portion near the distal end thereof. Since the distal end of the cap is tapered, it may be difficult for the worker to hold the distal end. However, the convex portions are formed on the inclined faces and accordingly, the cap can be readily held, which renders the detaching work easy.

In attachment of the connector to the mounting hole of the panel, there is a case where the worker's hand slips on the panel P immediately after insertion of the distal end of the cap into the mounting hole and the cap happens to fall off from the connector. However, since the cap is hooked at the convex portions on the edge defining the mounting hole, the falling off of the cap from the connector can be prevented. Furthermore, the convex portions are so formed as not to prevent the insertion of the distal end of the cap.

Each convex portion preferably has elasticity such that it deforms in a direction in which the connector is inserted into the mounting hole. The convex portions abut against the edge defining the mounting hole of the panel and flex when the protecting cap is inserted into the connector. Accordingly, the inserting work is not prevented. On the other hand, the convex portions would flex and detach from the edge defining the mounting hole if a force applied to it is large when it is pulled out of the connector. However, since such a large force is not required, the cap can be hooked at the convex portions thereof on the edge defining the mounting hole and accordingly, the cap can be prevented from falling off.

Each convex portion preferably stands on the inclined face so as to be inclined in a direction opposite the direction in which the connector is inserted into the mounting hole. In this construction an angle of flection of each convex port ion can be rendered small when the protecting cap is inserted into the connector, and the angle of flection can be rendered large when the cap is pulled out of the connector. Accordingly, the resistance is small when the cap is inserted into the connector, while it is large when it is pulled out of the connector.

The connector is usually provided with locking arms each including a claw-like engagement protrusion formed on the distal end thereof. The engagement protrusions engage the side of the panel. The engagement protrusions protrude outward relative to the mounting hole. When the connector is pushed into the mounting hole, the inclined faces of the protecting cap slide on the edge defining the hole, thereby guiding the connector to the normal position. In this case, since the inclined faces of the protecting cap are located outward relative to the distal ends of the locking arms provided with the respective engagement protrusions. Consequently, the distal ends of the locking arms can be prevented from being hooked on the edge of the mounting hole.

The lid portion may have the shape of a box and the inclined faces are formed by notching the distal end corners of the lid portion. Furthermore, each inclined face may have an arcuate surface. Thus, each inclined face may have various shapes.

BRIEF DESCRIPTION OF THE DRAWINGS

Other objects, features and advantages of the present invention will become clear upon reviewing the following description of the preferred embodiments thereof, made with reference to the accompanying drawings, in which.

DETAILED OF THE PREFERRED EMBODIMENTS

Figure 1:
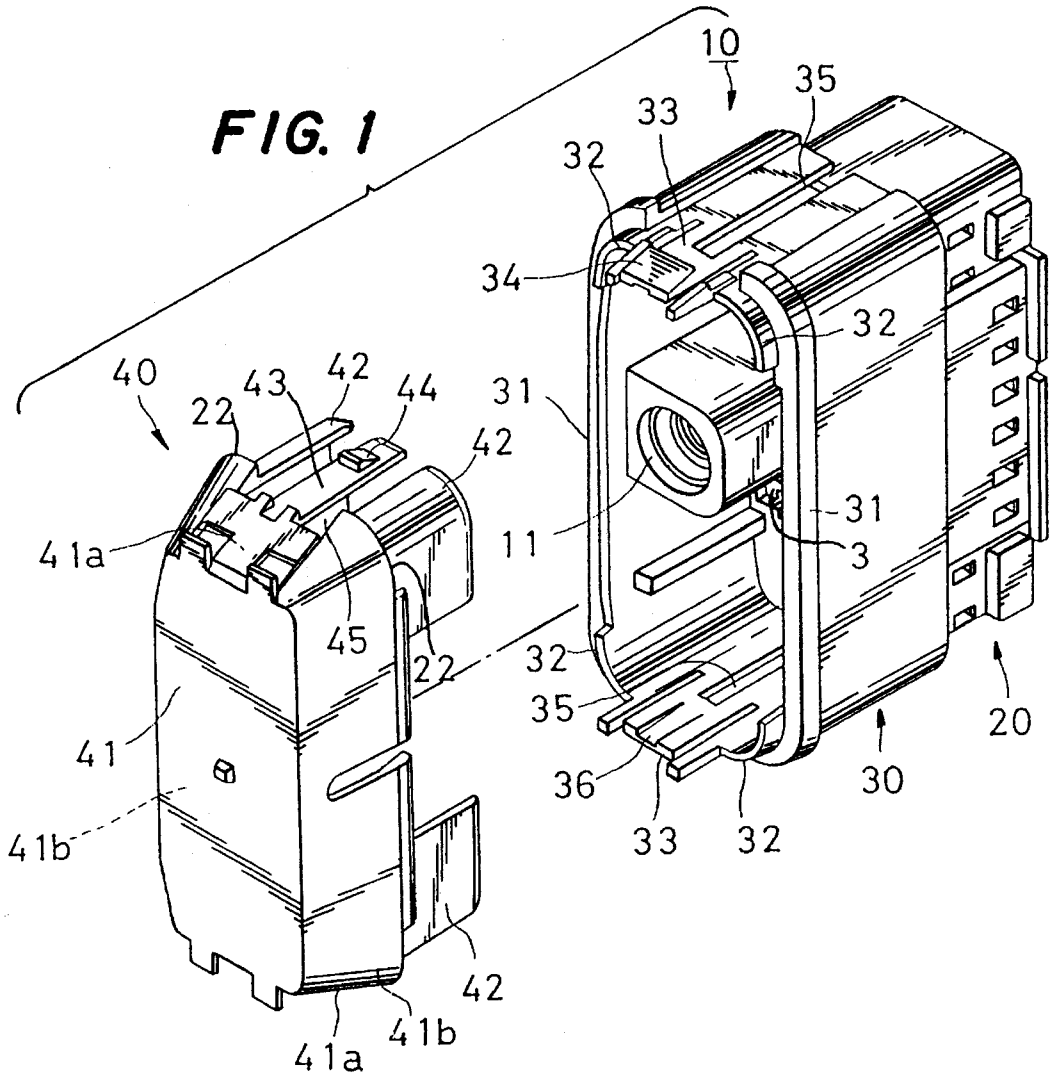
FIG. 1 is a perspective view of a first embodiment of a panel-mounted electrical connector and a protecting cap unattached to the connector in accordance with the present invention.
Figure 2:
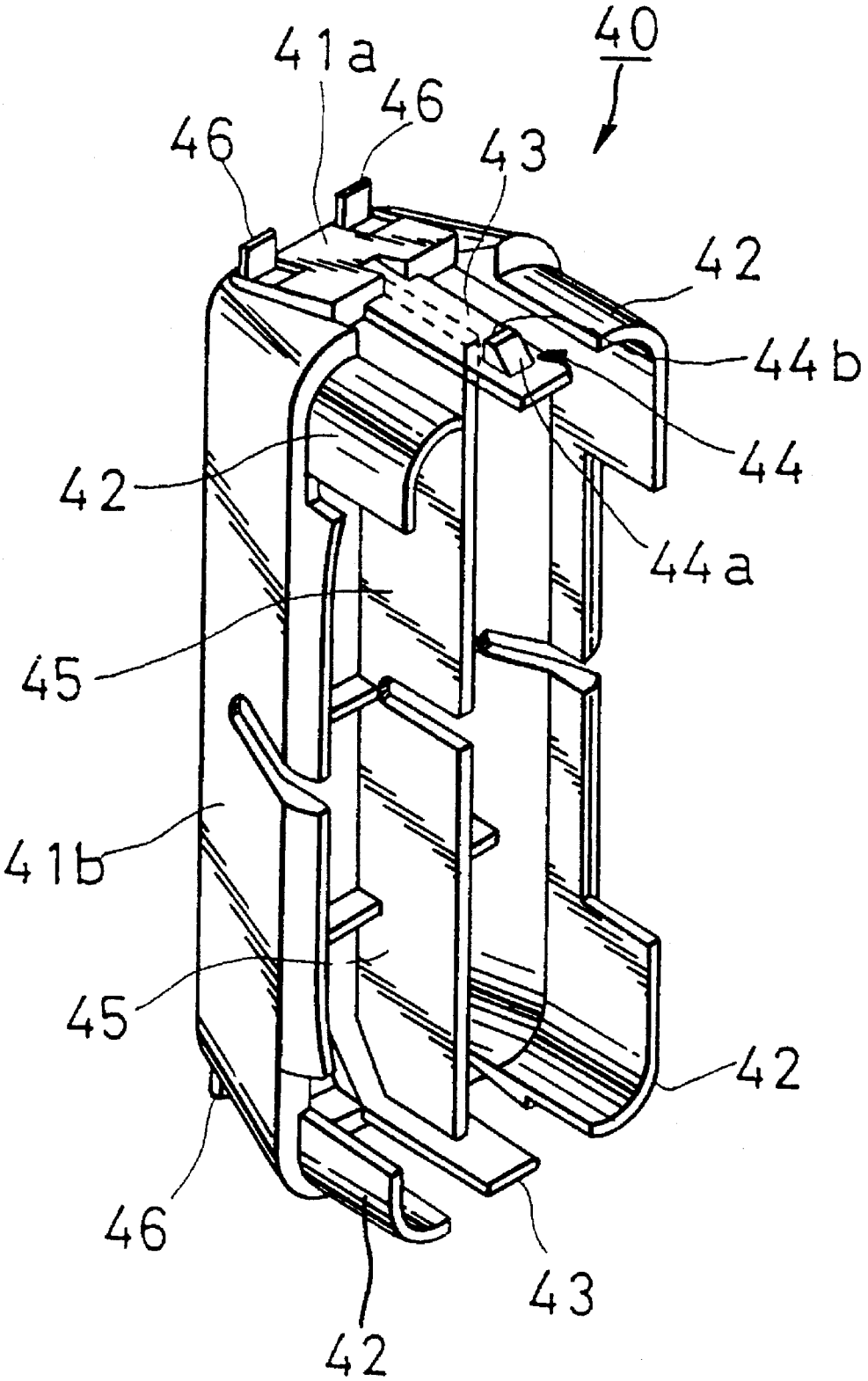
FIG. 2 is a perspective view of the protecting cap.
Figure 3:
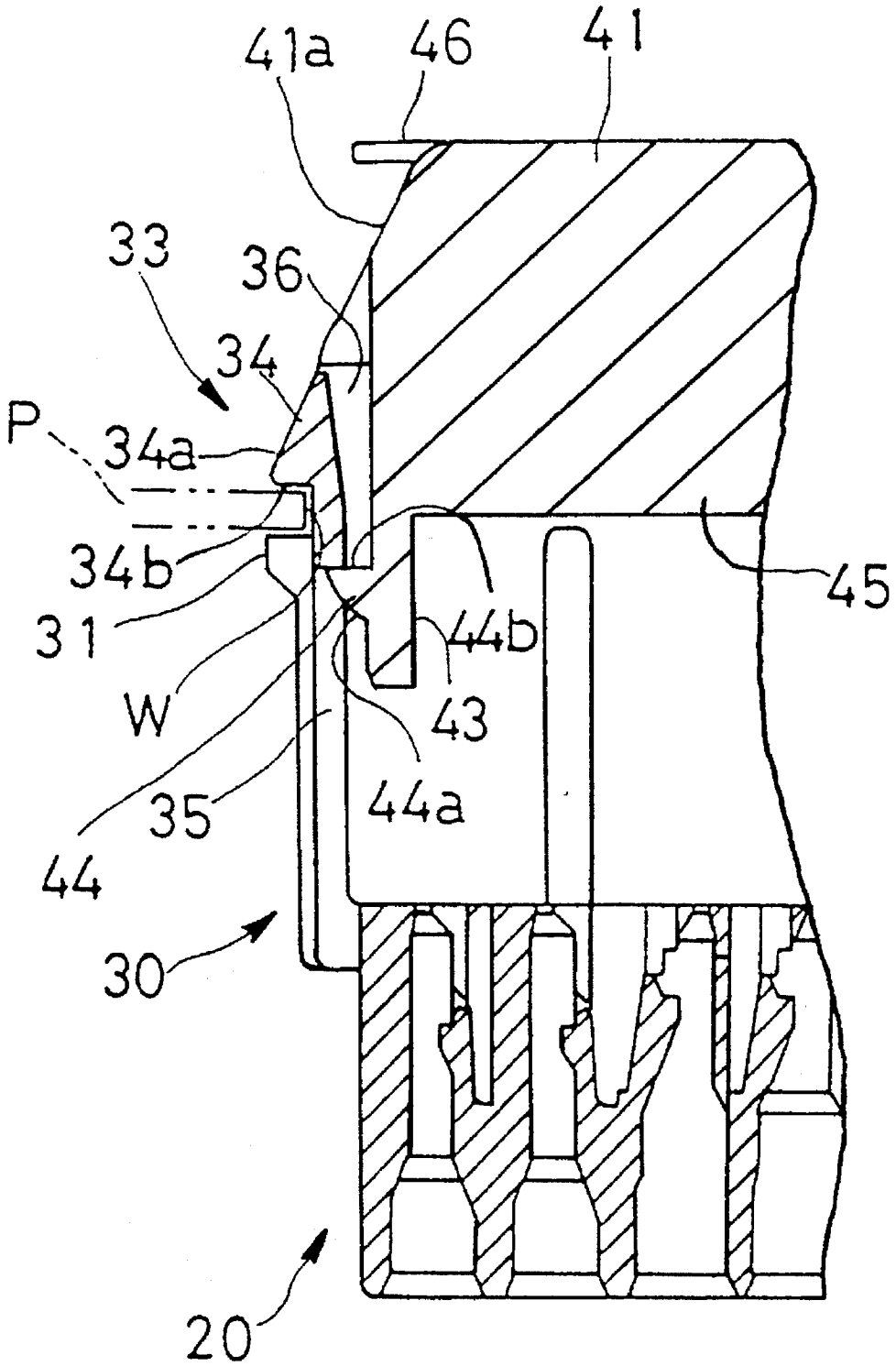
FIG. 3 is a partial sectional view of the connector and the protecting cap attached to the connector.

A first embodiment of the present invention will be described with reference to FIGS. 1 to 3. In the first embodiment, the invention is applied to a male connector used in the automobile. The panel-mounted connector 10 comprises a generally rectangular body 20 holding therein a plurality of male terminals (not shown). The body 20 includes a forwardly projecting generally cylindrical hood 30 surrounding portions of the male terminals fitted with female terminals (not shown). The size of the hood 30 is set so that the female terminals can be inserted thereinto. The female terminals are inserted into the hood 30 to be connected to the respective male terminals.

The hood 30 has a rectangular section with rounded corners. The hood 30 has an open end and a flange 31 formed on the outer periphery of the open end thereof except for at the central portions of the upper and lower walls. Four plate-like positioning ribs 32 extend outward from the respective corners of the hood 30. Two plate-like locking arms 33 are formed on the central portions of the upper and lower walls of the hood 30 where the flange 31 is not formed. The locking arms 33 project slightly forward relative to the positioning ribs 32. Each locking arm 33 has an engagement protrusion 34 formed on the outer peripheral surface of its distal end. Each engagement protrusion 34 includes an inclined sur face **34*a* and a vertical wall surface 34*b* formed at the terminal end of the inclined surface 34*a*. The distance between the vertical wall surface 34*b* and the flange 31 is approximately equal to the thickness of a panel P. The hood 30 is cut so that the locking arms 33** flex readily.

A protecting cap 40 is attached to the hood 30 of the connector 10 to close the open end, thereby protecting the male terminals held in the hood 30. The protecting cap 40 comprises a lid portion 41 closing the hood 30. The sectional configuration of the attached end of the lid portion 41 is the same as that of the open end of the hood 30. The protecting cap 40 generally has the shape of a dome with a tapered forward end. More specifically, the protecting cap 40 has upper and lower inclined faces **41*a* and right-hand and left-hand inclined faces 41*b* such that the cap 40 has generally trapezoidal transverse and longitudinal cross sections. The upper and lower inclined faces 41*a* of the lid 41 are so formed as to be substantially aligned with the inclined faces 34*a* of the engagement protrusions 34 formed on the distal ends of the locking arms 33, respectively, when the protecting cap 40 has been attached to the connector 10, as shown in FIG. 3. The protecting cap 40 is designed not to project outward of the positioning ribs 32** and to pass through the mounting hole W of the panel P.

The protecting cap 40 has four plate-like mounting ribs 42 formed to project from four corners of the side thereof from which the cap 40 is attached to the hood 30, respectively. The mounting ribs 42 are inserted along the inner surface of the respective positioning ribs 32. The protecting cap 40 further has two plate-like deformation preventing portions 43 formed on the central portions of the respective upper and lower walls. Each deformation preventing portion 43 projects toward the side of the hood 30 as between the mounting ribs 42. The deformation preventing portions 43 correspond to the respective locking arms 33. Ribs 45 are formed between the deformation preventing portions 43 on the inner surface of the protecting cap 40 so that the deformation preventing portions 43 are reinforced.

The distal end of each deformation preventing portion 43 is not reinforced by the rib 45 so as to have elasticity. Each deformation preventing portion 43 has an engagement protrusion 44 formed on the outer peripheral side of the distal end thereof. Each engagement protrusion 44 includes an inclined face **44*a* projecting outward and a vertical wall face 44*b* formed at the terminal end of the inclined face 44*a*. The engagement protrusion 44 is to be supported on a locking arm 33 at the central portion in the direction of the width thereof. The hood 30 has two engagement grooves 35 each extending inwardly from the base of each locking arm 33 so that each engagement groove 35 is contiguous to the inside and outside of the hood 30. The engagement grooves 35 are disposed to correspond to the respective engagement protrusions 44. Since the engagement protrusions 44 are received in the respective engagement grooves 35 inside the hood 30, the height of each engagement protrusion 44 is set so that the distance between the tops of the engagement protrusions 44 is larger than the distance between the inner faces of the locking arms 33. Each locking arm 33 has a guide groove 36 formed in the distal end of the inner face thereof along an insertion path of the engagement protrusion 44. Each guide groove 36 becomes shallower as it goes inward. Pairs of engagement members are constituted by the mounting ribs 42 and the engagement protrusions 44**.

In the attaching of the cap 40 to the connector 10, the ribs 45 are inserted along the inner faces of the positioning ribs 32 of the hood 30, respectively. In this case, the engagement protrusions 44 of the deformation preventing portions 43 are first inserted into the respective guide grooves 36 so that the cap 40 is positioned. Then, the cap 40 is gradually inserted into the hood 30. When each engagement protrusion 44 is inserted with its positional shift in the direction of the width restricted by the guide groove 36, the mounting ribs 45 are inserted along the inner faces of the respective positioning ribs 32.

A positional shift of the engagement protrusions 43 is not caused once the ribs 45 have been inserted in the inner faces of the respective positioning ribs 32. Then, the guide grooves 36 are not necessary, and each engagement protrusion 44 climbs over the inclined face defining the guide groove 36 to be gradually pushed inward such that the distal end of each locking arm 33 flexed inward. When the cap 40 is pushed in such that the ribs 45 have been completely inserted in the hood 30, the vertical wall face **44*b* of each engagement protrusion 44 is located at the distal end of the engagement groove 35 of the hood 30, as shown in FIG. 3. Each deformation preventing portion 43 then returns to its normal shape such that the engagement protrusions 44 invade the engagement grooves 35, engaging the locking arms 33**, respectively.

The locking arms 33 are located outside the respective deformation preventing portions 43 when the protecting cap 40 has been attached to the connector 10, as described above. Accordingly, each locking arm 33 abuts against the deformation preventing portion 43 when something strikes against the outer face of each locking arm during transportation and a force acts on each locking arm 33 to cause it to be pushed inward. However, the locking arms 33 are held by the deformation preventing portions 43 from the inside, respectively, such that each locking arm is prevented from flexing to such a degree that it cannot return to its normal shape.

Two plate-shaped convex portions 46 are formed on each of upper and lower distal end corners of the protecting cap 40 so as to project outward. The height of each convex portion 46 is determined so that each convex portion 46 does not extend outwardly of the projected area of the remainder of the cap 40. Each convex portion 46 is inclined rearward. Since each convex portion 46 has the shape of a plate, it has elasticity so as to flex forward and rearward. Since each convex portion 46 is inclined rearward, the force necessary to flex it rearward is smaller than the force.

The protecting cap 40 is designed not to project outward of the positioning ribs 32 and to pass through the mounting hole W of the panel P, as described above. Furthermore, since the distal end of the cap 40 is tapered, the distal end is sufficiently smaller than the mounting hole W such that it can be inserted into the mounting hole W readily. For example, holding the connector body 20 and abutting the distal end of the cap 40 against the panel P, the worker needs to fumble for the hole W when the hole cannot be viewed. Since the conventional protecting cap has a distal end whose configuration is substantially the same as that of the mounting hole, the protecting cap cannot be inserted into the mounting hole until the center position and the relative angle of the protecting cap correspond to those of the mounting hole. However, since the distal end of the protecting cap 40 is tapered in the present embodiment, the distal end of the cap 40 can be easily inserted into the mounting hole W even when there is a positional shift between the cap and the hole. When the distal end of the cap 40 has invaded the hole W, the inclined faces **41*a* and 41*b* slide on the edge of the panel defining the mounting hole W as the cap 40** is further pushed into the hole. Thus, the positional shift is gradually corrected and the cap is accurately positioned.

The convex portions 46 abut against the edge of the mounting hole when the distal end of the cap 40 is inserted into the hole. However, since the convex portions 46 are formed partially on the distal end of the cap, the inserting work is not interrupted. Furthermore, since each convex portion 46 has elasticity, it readily flexes even if it abuts against the edge defining the mounting hole W. In particular, since each convex portion 46 can readily flex rearward, it does not cause any problem when the worker fumbles for the mounting hole W and pushes the cap into the hole.

There is a case where the worker's hand slips on the panel P immediately after insertion of the distal end of the cap into the mounting hole W and the connector 10 happens to fall off from the worker's hand. Furthermore, the connector 10 needs to be passed from one hand to the other depending upon the condition of the harness connected to the connector. In these cases, the protecting cap easily falls out from the connector because of its weight. In particular, the protecting cap such as the cap 40 having the tapered distal end easily falls out from the connector. However, since the convex portions 46 are hooked on the edge defining the mounting hole W, the falling off can be prevented. Since each convex portion 46 is inclined rearward, it needs to flex sufficiently forward before the protecting cap falls off from the connector.

Upon insertion of the distal end of the protecting cap, the connector 10 is gradually pushed into the mounting hole, so that any one of the inclined faces **41*a*, 41*b* of the lid portion 41 slides on the edge defining the mounting hole, thereby guiding the protecting cap to its normal position as the connector is inserted into the mounting hole. The, when the inclined faces 34*a* of the engagement protrusions 34 of the locking arms 33 abut against the edge defining the mounting hole W, the edge defining the mounting hole causes the locking arms 33 to flex inwardly. Since the upper and lower inclined faces 41*a* of the lid portion 41 are aligned with the inclined faces 34*a* of the engagement protrusions 34 respectively, the locking arms 33 do not abut against the edge defining the mounting hole W but smoothly slide thereon. When the locking arms 33 start flexing inwardly, the positioning ribs 32 invade the mounting hole W to abut against the edge of the hole from the inside, thereby positioning the connector 10. When the connector 10 is inserted into the mounting hole W until the flange 31 abuts against the panel P, the vertical wall faces 34*b* of the engagement protrusions 34 are located at one side of the panel P. Then, each locking arm 33 having flexed returns to its normal shape. Consequently, the panel P is held between the engagement protrusions 34 and the flange 31 and the locking arms 33** engage the panel P.

The protecting cap 40 is detached from the connector when the female connector is connected to the male connector. Since the cap 40 is tapered, it is difficult to pull the cap out of the connector. However, since the convex portions 46 are formed on the corners of the upper and lower inclined faces 41*b*, the cap 40 can be held and pulled out easily by grouping these convex portions.

Figure 4:
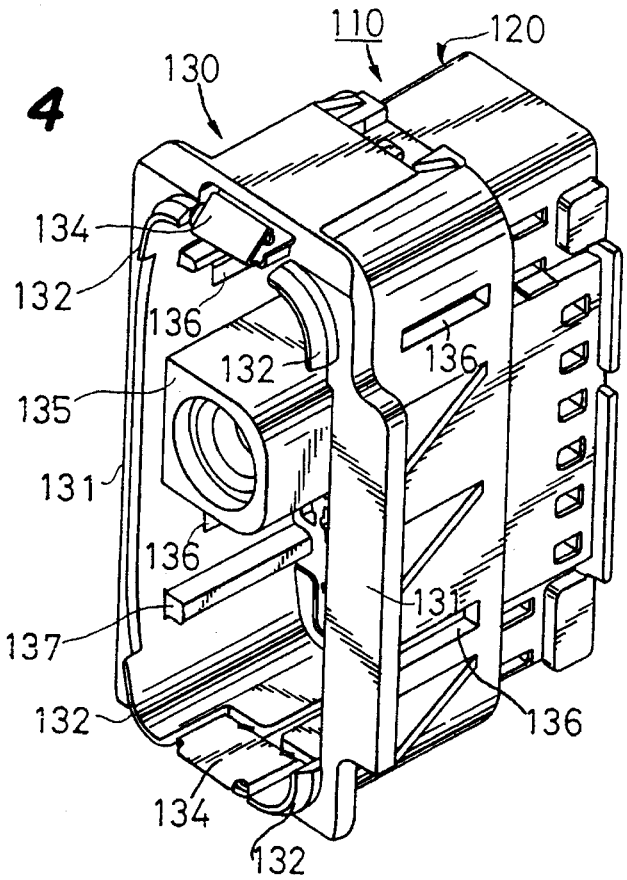
FIG. 4 is a perspective view of a second embodiment of the connector.
Figure 5:
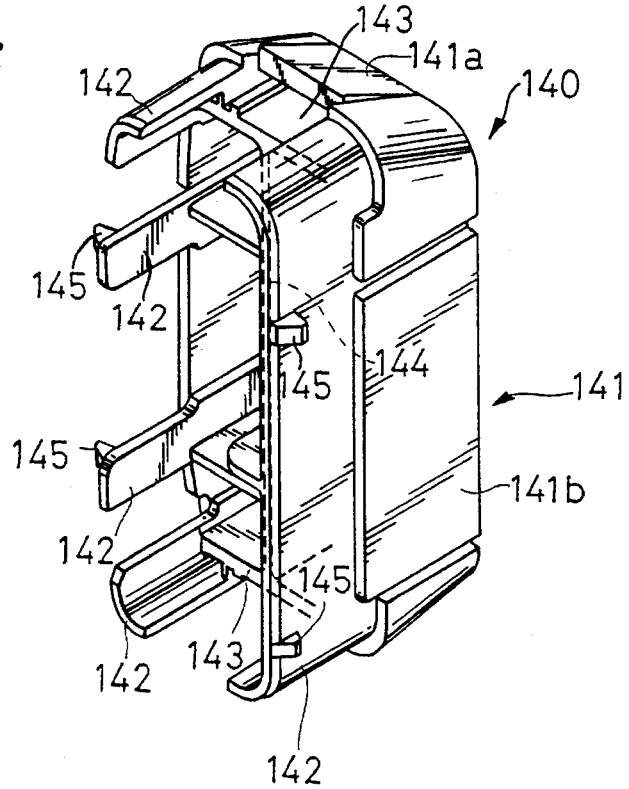
FIG. 5 is a perspective view of the protecting cap.
Figure 6:
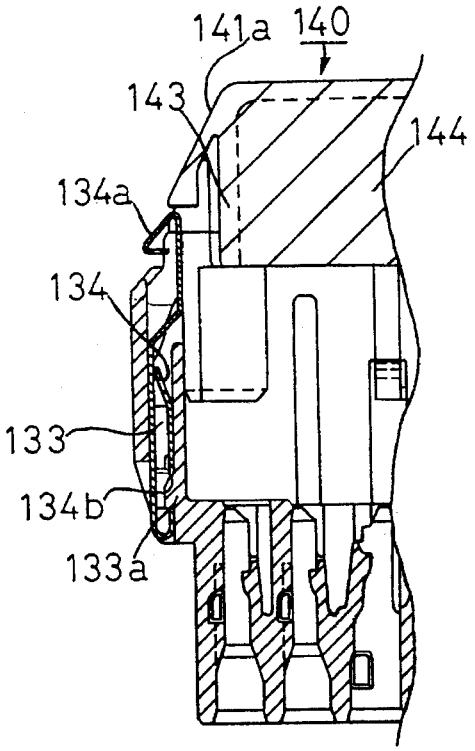
FIG. 6 is a partial sectional view of the connector and the protecting cap attached to the connector.
Figure 8:
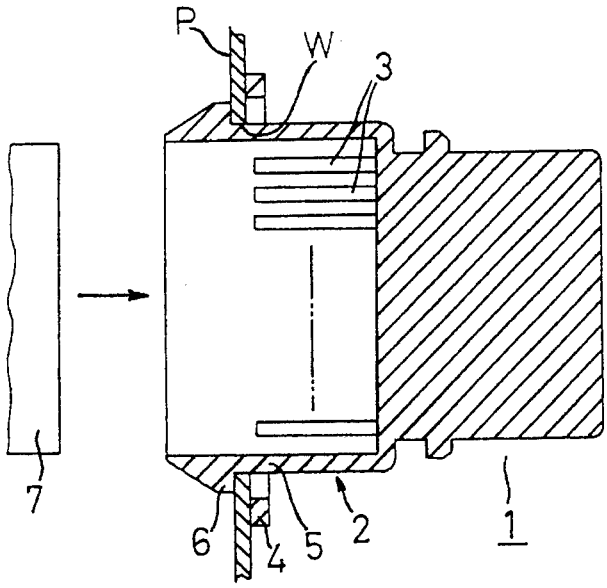
FIG. 8 is a partial sectional view of a conventional connector and protecting cap.

FIGS. 4 to 6 illustrate a second embodiment of the invention.

The flange 131 is formed on the entire outer periphery of the open end of the hood 130. The plate-like positioning ribs 132 project forward from the corners of the hood 130. The hood 130 has two arm-holding chambers 133 extending longitudinally through the upper and lower walls thereof, respectively. An engagement protrusion 133*a* is formed on the rear portion of the wall to project into the arm-holding chamber 133.

Each locking arm 134 is formed by bending a band-shaped metal plate. The front end of each locking arm 134 is folded rearward such that the engagement protrusion portion 134*a* is formed. The rear end of each locking arm 134 is folded forward, and an engagement hole 134*b* into which the engagement protrusion 133*a* can be inserted is formed in the ear end of the locking arm 134.

Each locking arm 134 is inserted into the arm-holding chamber 133 from the end at which the engagement hole 134*b* is formed, and the engagement protrusion 133*a* is inserted into the engagement hole 134*b*, whereby each locking arm 134 is held in the arm-holding chamber 133, as shown in FIG. 6. Since the front end of each arm holding chamber 133 is located inward relative to the rear end thereof, the distal end of each locking arm 134 on which the engagement protrusion 134*a* is formed can readily flex into the hood 130. When the locking arms 134 have been held in the respective arm-holding chambers 133, the engagement protrusions 134*a* project outward and the edge defining the mounting hole W of the panel P is held between the engagement protrusions 134*a* and the flange 131, whereby the engagement protrusions 134*a* engage the edge defining the hole W.

A part of the side wall of the hood 130 extends inwardly to form a female screw section 135 defining a female thread projecting toward the open end of the hood 130. Engagement grooves 136 and ribs 137 guiding the female connector are formed in the upper and lower portions of each of the right-hand and left-hand side walls. Each engagement groove 136 is open to the inside and outside of the hood 130.

The protecting cap 140 includes the lid portion 141 having the shape of a dome and closing one end of the hood 130. The lid portion 141 includes the upper and lower inclined faces 141*a* and right-hand and left-hand inclined faces 141*b* such that the lid portion 141 has generally trapezoidal transverse and longitudinal sections. The protecting cap 140 is designed not to project outward of the positioning ribs 132 and to pass through the mounting hole W of the panel P. Furthermore, the upper and lower inclined faces 141*a* of the protecting cap 140 are located outwardly relative to the distal ends of the locking arms 134.

The cap 140 has positioning ribs 142 each projecting from an opening of the lid portion 141 along the inner peripheral face of the hood 130. Central portions of upper and lower walls of each positioning rib 142 are notched and the width of each notched portion is slightly larger than that of the locking arms 134. Unnotched portions of the upper and lower walls serve as the deformation preventing portions 143, respectively. The rib 144 reinforcing both deformation preventing portions 143 extends between the deformation preventing portions 143. A part of each positioning rib 142 is cut off so as not to interfere with the projecting portion formed on the side wall of the hood 130. The cap 140 has on the outer peripheral face of its distal end the engagement protrusions 145 formed to correspond to the respective engagement grooves 136 formed in the hood 130. Pairs of engagement members constituted by the positioning ribs 142 and the engagement protrusions 145.

To attach the protecting cap 140 to the connector 110, the cap 140 is inserted into the hood 130 leading with the positioning ribs 142. When the positioning ribs 142 have been completely inserted into the hood 130, the engagement protrusions 145 invade the respective engagement grooves 136, whereby the cap 140 engages the connector 110. FIG. 6 illustrates the state in which the engagement protrusions 145 are received in the respective engagement grooves 136. In this state, each deformation preventing portion 143 is located to the inside of the distal end of locking arm 134 with a small gap therebetween. In the state that the protecting cap 140 has been inserted in the hood 130, each locking arm 134 abuts against the deformation preventing portion 143 located inside when something strikes against the outer face of each locking arm 134 during the transportation such that a force pushing each locking arm 134 inward is applied thereto. However, since the locking arms 134 are held by the deformation preventing portions 143 located inside, each locking arm 134 can be prevented from flexing to such a degree that it cannot return to its normal shape.

The distal end of each locking arm 134 is slightly away from the outer face of the deformation preventing portion 143, and each positioning rib 142 is notched by the length corresponding to the width of the locking arm 134. Accordingly, each locking arm 134 can flex inward until its distal end abuts against the deformation preventing port ion 143. Furthermore, the protecting cap 140 does not project outside the positioning ribs 132 of the connector 110. Accordingly, the connector 110 can be inserted into the mounting hole W of the panel P with the protecting cap 140 being attached thereto. Furthermore, since the distal end of the cap 140 is tapered, the distal end is sufficiently smaller than the mounting hole W such that the cap 140 can be readily inserted into the connector 110. In particular, since the distal ends of the locking arms 134 are not located outside the upper and lower inclined faces 141*a*, 141*b* of the cap 140, the engagement protrusions 134*a* start smoothly contacting the edge defining the mounting hole W when the inclined faces 141*a*, 141*b* position the cap, sliding on the edge defining the hole W. Accordingly, the locking arms 134 can flex inwardly.

Since the distal end of the protecting cap 140 is tapered, the distal end of the cap 140 can be easily inserted into the mounting hole W even when there is a positioning offset between the cap and the hole. When the distal end of the cap 140 has invaded the hole W, the inclined faces 141*a* and 141*b* slide on the edge defining the mounting hole W as the cap 140 is further pushed into the hole. Thus, the positional offset is gradually corrected and the cap is accurately positioned.

Upon insertion of the distal end of the protecting cap, the connector 110 is gradually pushed into the mounting hole, so that any one of the inclined faces 141*a*, 141*b* slide on the edge defining the mounting hole, thereby guiding the protecting cap to its normal position as the connector is inserted into the mounting hole. When the locking arms 133 start flexing inwardly, the positioning ribs 132 invade the mounting hole W to abut against the edge of the hole from inside, thereby positioning the connector 110. When the connector 110 is inserted into the mounting hole W until the flange 131 abuts against the panel P, the engagement protrusions 134*a* are located at one side of the panel P. Then, each locking arm 133 having flexed returns to its normal shape, as shown in FIG. 6. Consequently, the panel P is held between the engagement protrusions 134 and the flange 131, and the locking arms 133 engage the panel P.

Figure 7A:
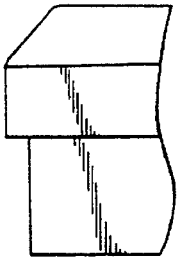
FIGS. 7A, 7B and 7C are schematic views of modified forms of the connector and the protecting cap.
Figure 7B:
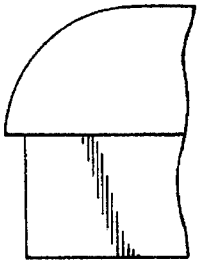
Figure 7C:
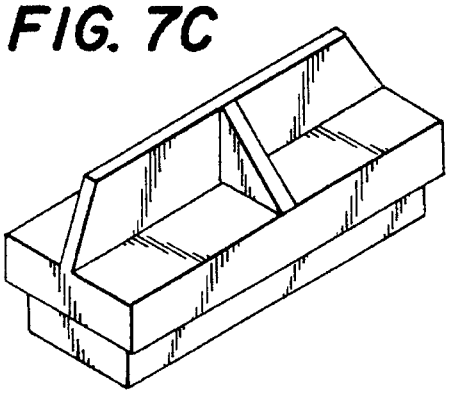
Figure 9:
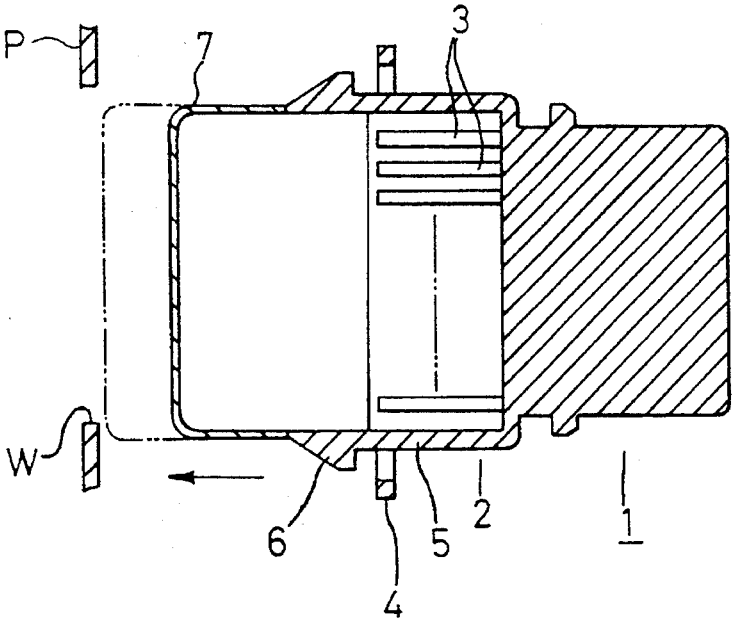
FIG. 9 is a sectional view of the conventional connector with the protecting cap being attached thereto for explaining the mounting of the connector on a panel.

Although the straight inclined faces are formed by the entire faces of the side walls of the lid portion in the foregoing embodiments, only the distal end corners of the lid portion may be formed into the inclined faces, as shown in FIG. 7A. Furthermore, each inclined face may be curved as shown in FIG. 7B. Additionally, a rib may be provided on the distal end of the lid portion so as to project and end faces of the rib may be inclined as shown in FIG. 7C.

The foregoing disclosure and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. The combination of a protecting cap and an electrical connector, said electrical connector including a cylindrical portion having an open end and a plurality of terminals disposed within said cylindrical portion, the protecting cap being attached to said cylindrical portion, and the protecting cap comprising a lid portion covering the open end of the cylindrical portion of the connector, the lid portion having faces inclined inwardly in a direction away from the open end of said cylindrical portion such that the lid portion tapers in said direction away from the open end of said cylindrical portion, and a pair of engagement members engaging the cylindrical portion of the connector and attaching said protecting cap directly to said connector, whereby said protecting cap will protect said terminals during transportation of the electrical connector to a panel to which the connector is to be mounted.

2. The combination of a protecting cap and electrical connector according to claim 1, wherein said protecting cap includes convexities protruding outward from the lid portion to locations within the projected area of a widest part of the lid portion which widest part is located closest to the open end of the cylindrical portion of said electrical connector.

3. The combination of a protecting cap and electrical connector according to claim 2, wherein each of said convexities has elasticity such that it can flex in a direction toward said electrical connector.

4. A protecting cap according to claim 3, wherein each of said convexities is inclined, from a base thereof at which the convexity connects to said lid portion, toward the cylindrical portion of said electrical connector.

5. The combination of a protecting cap and an electrical connector according to claim 1, wherein each of said engagement members includes an engagement protrusion projecting in a radially outward direction, and the inclined faces of the protecting cap have rear ends closest to the cylindrical portion of said electrical connector, the rear ends being located radially outwardly of the engagement members.

6. The combination of a protecting cap and electrical connector according to claim 1, wherein the lid portion has the shape of a box and the inclined faces are formed only at a distal end of the lid portion remote from said connector.

7. The combination of a protecting cap and electrical connector according to claim 2, wherein each of the inclined faces are arcuate.

8. The combination of a protecting cap and electrical connector as claimed in claim 1, wherein the entirety of said protecting cap is located within the projected area of said electrical connector.

* * * * *